US008979518B2

(12) United States Patent
Laetzel et al.

(10) Patent No.: US 8,979,518 B2
(45) Date of Patent: Mar. 17, 2015

(54) HYDRAULIC TOOTHED WHEEL MACHINE

(75) Inventors: Marc Laetzel, Stuttgart (DE); Michael Wilhelm, Vaihingen/Enz (DE); Dietmar Schwuchow, Stuttgart (DE); Guido Bredenfeld, Marbach (DE); Stefan Cerny, Ludwigsburg (DE); Sebastian Tetzlaff, Reinsdorf (DE); Klaus Griese, Kupferzell (DE)

(73) Assignee: Robert Bosch GmbH, Stuttgart (DE)

( * ) Notice: Subject to any disclaimer, the term of this patent is extended or adjusted under 35 U.S.C. 154(b) by 458 days.

(21) Appl. No.: 13/256,053

(22) PCT Filed: Feb. 25, 2010

(86) PCT No.: PCT/EP2010/001163

§ 371 (c)(1),
(2), (4) Date: Jan. 30, 2012

(87) PCT Pub. No.: WO2010/102722

PCT Pub. Date: Sep. 16, 2010

(65) Prior Publication Data

US 2012/0114514 A1 May 10, 2012

(30) Foreign Application Priority Data

Mar. 12, 2009 (DE) ..... 10 2009 012 853

(51) Int. Cl.

| | |
|---|---|
| ***F01C 1/16*** | (2006.01) |
| ***F04C 15/00*** | (2006.01) |
| ***F04C 2/18*** | (2006.01) |

(52) U.S. Cl.

CPC ..... *F04C 2/18* (2013.01); *F04C 15/0042* (2013.01); *F04C 2240/50* (2013.01)

USPC ..... 418/201.1; 418/206.7

(58) Field of Classification Search

USPC ..... 418/201.1, 206.7, 206.5, 206.8, 206.6, 418/131–132, 206.1, 125, 128–129

See application file for complete search history.

(56) References Cited

U.S. PATENT DOCUMENTS

| | | | | |
|---|---|---|---|---|
| 3,658,452 | A | 4/1972 | Kita | |
| 4,343,602 | A * | 8/1982 | Meywald et al. | 418/77 |
| 4,781,552 | A | 11/1988 | Malfit | |

FOREIGN PATENT DOCUMENTS

| | | |
|---|---|---|
| DE | 199 24 057 | 11/2000 |
| EP | 1 291 526 | 3/2003 |
| IT | 1124357 | 5/1986 |
| WO | 2004/057193 | 7/2004 |

OTHER PUBLICATIONS

English language machine translation of WO 2004/057193.*

(Continued)

*Primary Examiner* — Mary A Davis
*Assistant Examiner* — Wesley Harris
(74) *Attorney, Agent, or Firm* — Maginot, Moore & Beck LLP

(57) ABSTRACT

A toothed wheel machine including a housing for receiving two meshing and especially helical-toothed wheels. The toothed wheels are axially mounted in a sliding manner by axial surfaces between bearing bodies received in the housing, and radially by a bearing shaft received in the bearing bodies. During the operation of the toothed wheel machine, an axial component of a force resulting from the hydraulic and mechanical forces generated during operation acts on each toothed wheel in the same axial direction. A counter-force against the respective axial force component is applied to the toothed wheels and/or bearing shafts, each counter-force applying the same amount of pressure as the respective axial force component, or less than same.

20 Claims, 4 Drawing Sheets

(56) References Cited

OTHER PUBLICATIONS

International Search Report corresponding to PCT Application No. PCT/EP2010/001163, mailed Jul. 18, 2011 (German and English language document) (8 pages).

Ivantysyn et al., Hydrostatische Pumpen und Motoren, 1993, pp. 337, 341, 347, and 348.

Rabie, M. Galal, Fluid Power Engineering, 2009, pp. 114-115, McGraw Hill.

Voith Turbo, IPH Catalog, High-pressure internal gear pumps, pp. 1-4, 2005.

* cited by examiner

HYDRAULIC TOOTHED WHEEL MACHINE

This application is a 35 U.S.C. §371 National Stage Application of PCT/EP2010/001163, filed Feb. 25, 2010, which claims the benefit of priority to application Ser. No. DE 10 2009 012 853.0, filed Mar. 12, 2009 in Germany, the disclosures of which are incorporated herein by reference in their entirety.

BACKGROUND

The disclosure relates to a hydraulic toothed wheel machine.

EP 1 291 526 A2 shows a toothed wheel machine having a housing in which two intermeshing toothed wheels supported in bearing bushes or bearing bodies are arranged, the housing being closed at the ends by a first and a second housing cover respectively. The helically toothed wheels are each supported in a sliding manner axially by two axial surfaces between the bearing bodies and radially by respective bearing shafts accommodated in the bearing bodies. During the operation of the toothed wheel machine, hydraulic and mechanical forces act on the toothed wheels along the same toothed wheel longitudinal axis in each case. To ensure that the first bearing body, which lies in the direction of action of the forces, is not pushed beyond the axial surfaces of the toothed wheels, between the toothed wheels and the first housing cover, and that only a small sliding gap occurs between the toothed wheels and the second bearing body, a counter-force is applied to the toothed wheels and to the first bearing body. This counter-force is larger than the hydraulic and mechanical forces, with the result that the first bearing body is pressed against the toothed wheels, the toothed wheels are pressed against the second bearing body, and the second bearing body is pressed against the second housing cover. All the resultant forces on the bearing bodies and the toothed wheels thus act in the direction of the second housing cover.

The counter-force on the toothed wheels is applied via pistons acting on the bearing shafts. The pistons are accommodated in a sliding manner, approximately coaxially with respect to the toothed wheel longitudinal axis, in an intermediate cover arranged between the first housing cover and the housing and rest by means of a first piston end face against a shaft end face of the bearing shafts which faces in the direction of the first housing cover and are each subjected to pressure by way of a second piston end face. The counter-force is applied to the first bearing body by way of a pressure field formed between the bearing body and the intermediate cover.

The disadvantage with this solution is that the entire assembly of bearing bodies and toothed wheels is pressed onto the second housing cover of the toothed wheel machine, with the result that the second housing cover and the housing are subjected to very high and uneven loads. Moreover, the pressing together of the toothed wheels and the bearing bodies results in very high wear between the axial surfaces of the toothed wheels and the bearing bodies.

SUMMARY

It is the object of the present disclosure to provide a hydraulic toothed wheel machine in which machine elements, in particular housing covers and housings, are subjected to little force and which is subject to minimal wear.

This object is achieved by a hydraulic toothed wheel machine in accordance with the features set forth below.

According to the disclosure, a toothed wheel machine has a housing for accommodating two intermeshing toothed wheels, in particular helically toothed wheels, which are supported in a sliding manner axially by axial surfaces between bearing bodies accommodated in the housing and radially by respective bearing shafts accommodated in the bearing bodies. During the operation of the toothed wheel machine, an axial force component of a force resulting from hydraulic and mechanical forces acts on each toothed wheel in the same axial direction. A counter-force against the respective axial force component is then applied to the toothed wheels and/or bearing shafts, the magnitude of said counter-force being equal to or less than that of the respective axial force component.

This solution has the advantage that the toothed wheels of the toothed wheel machine are each pressed against the bearing body lying in the direction of action of the axial force component by an axial force component reduced by the counter-force, with the result that there is a reduction in the sliding friction between the toothed wheels and the bearing body and the other bearing body, the one which does not lie in the direction of action of the axial force component, is not subjected to load. The axial force components reduced by the counter-forces can then be provided as axial-gap compensation for a sliding gap between the toothed wheels and the bearing bodies lying in the direction of action of the resultant force. Axial-gap compensation for a sliding gap between the toothed wheels and the bearing bodies that do not lie in the direction of action of the axial force component can be employed independently of the axial force components. It is furthermore possible, by means of the counter-force, to reduce loading due to the axial force component on the housing cover and the housing.

The toothed wheels of the toothed wheel machine are preferably helically toothed.

It is advantageous if the first bearing body, which lies in the direction of the effective axial force component, is pressed against a housing cover of the housing mechanically by way of the toothed wheels and/or hydraulically by way of a pressure force.

To make the second bearing body press lightly on the toothed wheels, a hydraulic pressure is applied to the bearing body at an end face facing away from the toothed wheels.

The counter-force acting on the toothed wheels and/or bearing shafts is preferably a hydraulic pressure force and/or a mechanical force.

It is advantageous if the counter-force acts on at least one toothed wheel by means of a pressure field between at least one toothed wheel and the first bearing body. A pressure pocket can simply be introduced into that axial surface of the at least one toothed wheel which faces the first bearing body in order to delimit the pressure field.

The axial surface of one toothed wheel consists of tooth faces and of an annular surface, and the pressure pocket is preferably an annular groove introduced into the annular surface and running approximately concentrically around a longitudinal axis of the corresponding toothed wheel. To enlarge the pressure field and hence the area of application of the hydraulic pressure, the annular groove can be enlarged by tooth pocket sections introduced into the tooth faces of the toothed wheel.

As a further development of the disclosure, the annular groove is introduced into that axial surface of the driving toothed wheel which faces the first bearing body, and the annular groove together with the tooth pocket sections is introduced into that axial surface of the driving toothed wheel which faces the first bearing body since the axial force component on the driving toothed wheel is larger than that on the driven toothed wheel.

It is expedient if the pockets are in pressure-medium communication with a high pressure of the toothed wheel machine.

A pressure field can be introduced into that end face of the second bearing body which faces away from the toothed wheels, and this can be brought about by pressing the second bearing body lightly against the toothed wheels.

It is advantageous if that end face of the second bearing body which faces away from the toothed wheels has introduced into it a first pressure groove, running concentrically all the way round a first bearing eye, and a second pressure groove, spanning a partial circle around a second bearing eye. The pressure grooves are then in pressure-medium communication with the high pressure of the toothed wheel machine via a pressure-medium port.

In a preferred embodiment of the toothed wheel machine, for each bearing shaft there is a piston supported in an axially movable manner in the housing cover of the housing, approximately coaxially with respect to the toothed wheel longitudinal axis, for applying force to the bearing shafts. The respective piston is arranged so as to rest approximately, by means of a first piston end face, against a shaft end face of the bearing shaft which faces in the direction of the axial force component, and has pressure applied to it by way of a second piston end face. The piston is a simple means of applying the mechanical counter-force to the bearing shafts.

For application of pressure, the second piston end faces are connected to the high pressure of the toothed wheel machine. The pressure force acting on the bearing shafts can be determined by means of the piston end face diameter.

Other advantageous developments of the hydraulic toothed wheel machine in accordance with the disclosure is set forth below.

BRIEF DESCRIPTION OF THE DRAWINGS

Preferred illustrative embodiments of an disclosure are explained in greater detail below with reference to schematic drawings. In the drawings.

DETAILED DESCRIPTION

Figure 1:
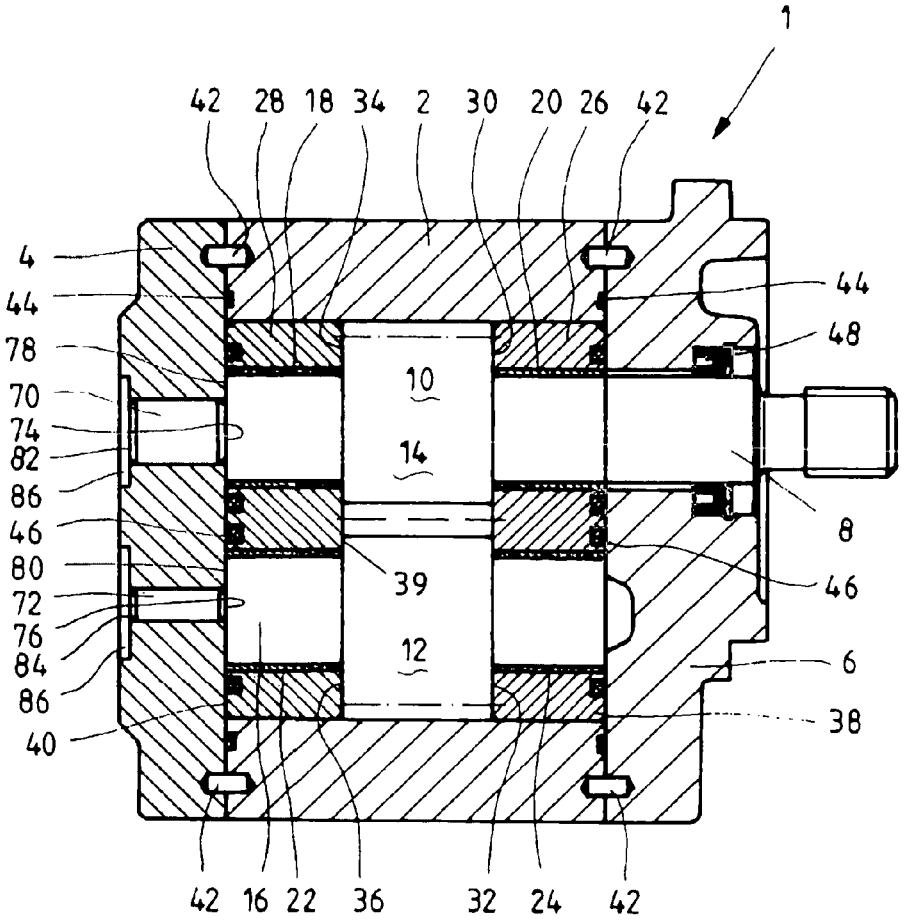
FIG. 1 shows a simplified illustration of a toothed wheel machine according to one illustrative embodiment in a longitudinal section.

FIG. 1 shows a hydraulic machine, embodied as a toothed wheel machine 1, according to one illustrative embodiment in a longitudinal section. This machine has a machine housing 2, which is closed by means of two housing covers 4 and 6. Housing cover 6 of the toothed wheel machine 1, which is on the right in FIG. 1, is penetrated by a first bearing shaft 8, on which a first toothed wheel 10 is arranged within the machine housing 2. The first toothed wheel 10 is in engagement with a second toothed wheel 12 by way of helical toothing 14, toothed wheel 12 being arranged on a second bearing shaft 16 for conjoint rotation therewith. The first and second bearing shafts 8 and 16 are each guided in two plain bearings 18, 20 and 22, 24 respectively. The plain bearings 20, 24 on the right in FIG. 1 are accommodated in a bearing body 26, and the plain bearings 18, 22 on the left in FIG. 1 are accommodated in a bearing body 28. The toothed wheels 10 and 12 are each supported in a sliding manner in the axial direction by respective first axial surfaces 30 and 32 on the second bearing body 26 (on the right) and by respective second axial surfaces 34 and 36 on the first bearing body 28 (on the left). To reduce friction, sliding surfaces between the toothed wheels 10, 12 and the bearing bodies 26, 28 can be provided with an anti-friction coating, such as $MoS_2$, graphite or PTFE. Respective end faces 38 and 40 of the bearing bodies 26 and 28 face the housing covers 6 and 4.

The housing covers 4, 6 are aligned on the machine housing 2 by means of centering pins 42. A housing seal 44 is arranged between the housing covers 4 and 6 and the machine housing 2. Respective axial seals 46 are furthermore inserted into the end faces 38 and 40 of the bearing bodies 26 and 28 to separate a high-pressure zone from a low-pressure zone of the toothed wheel machine 1. A radial shaft seal ring 48 seals off the first bearing shaft 8 where it passes through the housing cover 6 on the right in FIG. 1.

Hydraulic and mechanical forces arise during the operation of the toothed wheel machine 1, this being illustrated schematically in detail in FIG. 2 below.

Figure 2:
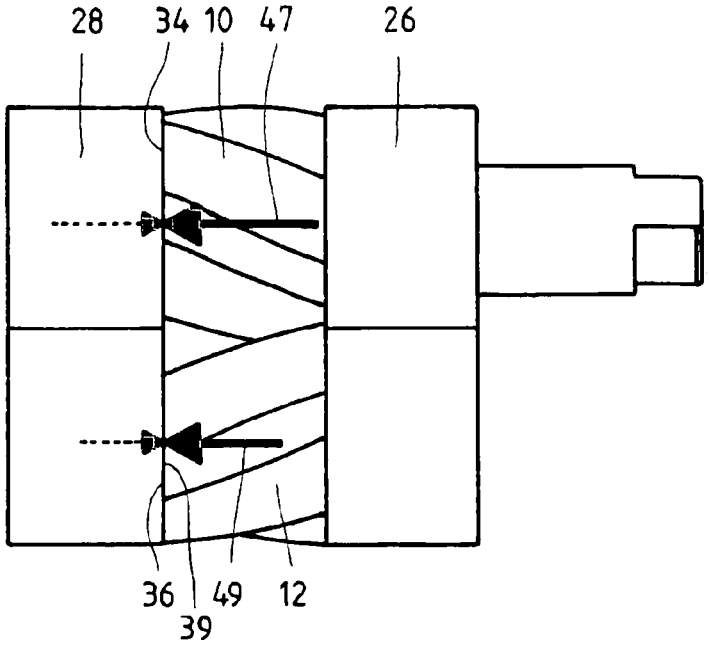
FIG. 2 shows a simplified illustration of an assembly of bearing bodies and toothed wheels of the toothed wheel machine from FIG. 1, in a side view.

FIG. 2 shows a simplified illustration, in side view, of an assembly of toothed wheels 10 and 12 and bearing bodies 26 and 28 in order to illustrate the hydraulic and mechanical forces that arise during operation in the toothed wheel machine 1 from FIG. 1. A force component of a hydraulic force acts in the same axial direction on both toothed wheels 10, 12, toward the left in FIG. 2. In addition, a driving toothed wheel, which is the upper toothed wheel 10 in FIG. 2, is acted upon by a mechanical force component of a mechanical force in the direction of action of the hydraulic force component, and a driven toothed wheel, which is the lower toothed wheel 12 in FIG. 2, is acted upon by a mechanical force component counter to the direction of action of the hydraulic force component. The hydraulic and mechanical force components each produce a resultant axial force component 47, 49 in the same direction (to the left in FIG. 2) on the toothed wheels 10, 12, although there is a difference in magnitude.

The toothed wheels 10 and 12 subjected to axial force components 47, 49 are each supported by axial surfaces 34 and 36, respectively, on the bearing body 28 on the left in FIG. 2. The right-hand bearing body 26 is not subject to the axial force components acting on the toothed wheels 10, 12. To reduce wear between the toothed wheels 10, 12 and the bearing body 28 on the left in FIG. 2, a counter-force is applied to the toothed wheels, this being indicated by dashed arrows in FIG. 2.

In FIG. 1, two cylindrical pistons 70, 72 are guided in an axially movable manner in housing cover 4. These have different diameters, with the upper piston in FIG. 1 having the larger diameter. The first piston 70 is arranged approximately coaxially with respect to the upper bearing shaft 8 in FIG. 1, and the second piston 72 is arranged approximately coaxially with respect to the lower bearing shaft 16. The respective pistons 70 and 72 rest by means of piston end faces 74 and 76 against shaft end faces 78 and 80 of the bearing shafts 8 and 16, said shaft end faces facing in the direction of the axial force component 49 in FIG. 2. A hydraulic pressure is applied to the pistons 70 and 72 via further piston end faces 82 and 84, and the pistons transmit this pressure axially to the bearing shafts 8 and 16 as a counter-force. To apply pressure to the piston end faces 82, 84, a pressure chamber 86 is provided, said pressure chamber being delimited by housing cover 4 and another housing cover, which is not shown. The pressure field is in pressure-medium communication with the high pressure of the toothed wheel machine 1.

The mechanical counter-force acting on the bearing shafts 8, 16 is determined by means of the piston diameter of the pistons 70, 72 and the level of pressure in the pressure chamber 86. Since the magnitude of the axial force components 47, 49 shown in FIG. 2 is different, the respective mechanical counter-force should likewise be different. As already described, the upper piston 70 in FIG. 1 has a larger diameter than the lower piston 72, with the result that the lower piston has a larger pressure application area and hence that a higher pressure force is transmitted as a counter-force to bearing shaft 8 via piston 70 if the pistons 70, 72 are acted upon by an equal pressure, as is the case in the illustrative embodiment. It would also be conceivable for the pistons 70, 72 to have an equal piston diameter and to be acted upon with different pressures or, in the case of different piston diameters, by different pressure levels. The counter-forces are smaller than the axial forces 47, 49, with the result that the toothed wheels 10, 12 are pressed against bearing body 28, and the latter is pressed against housing cover 4, by a resultant force.

Owing to the mechanical counter-force applied to the toothed wheels 10, 12 via the bearing shafts 8, 16, the remainder of the axial force is introduced into the housing 2, while bypassing bearing body 28.

Figure 3:
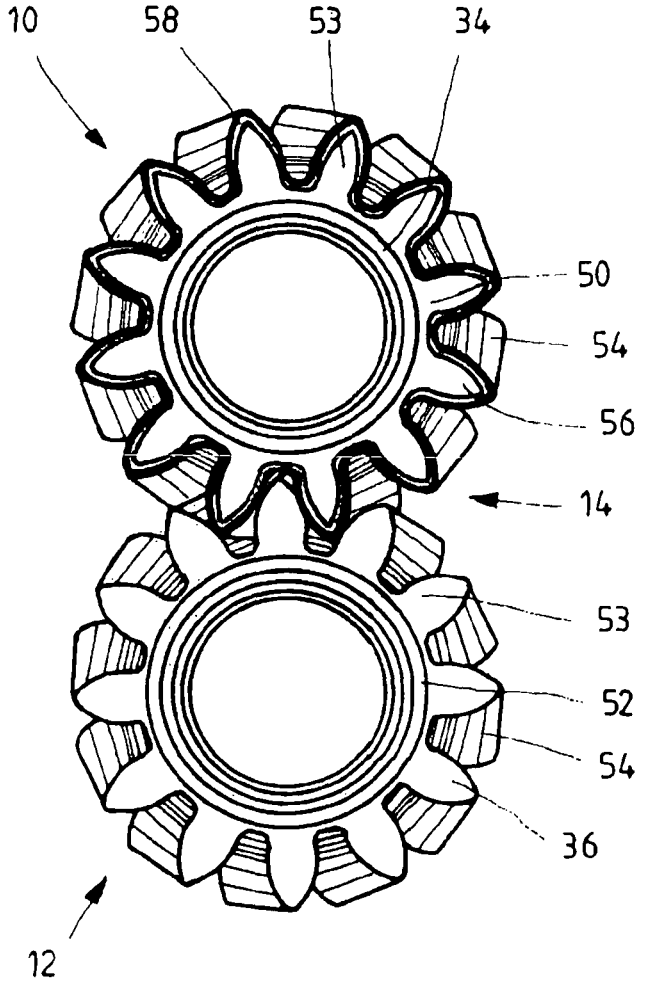
FIG. 3 shows a plan view of the toothed wheels of a second illustrative embodiment.

FIG. 3 shows a plan view of the axial surfaces 34, 36 of the toothed wheels 10, 12 of another illustrative embodiment, and an explanation of how a hydraulic counter-force is applied to the toothed wheels 10, 12 will be given below. The helical toothing 14 is clearly visible in FIG. 3. To apply a hydraulic counter-force to the respective axial force component 49 in FIG. 2 by application of pressure to the toothed wheels 10, 12, respective pressure pockets 50, 52 are introduced into each of the axial surfaces 34 and 36 of the toothed wheels 10 and 12. Together with the first bearing body 28 from FIG. 1, the pressure pockets 50, 52 each delimit a pressure field which is in pressure-medium communication with the high pressure of the toothed wheel machine 1. The pressure pocket 52 in toothed wheel 12 is designed as an annular groove 52 which is introduced around the axial surface 36 between the tooth end faces 53 of the teeth 54 of toothed wheel 12 and an outer circumferential surface of bearing shaft 16. In addition to an annular groove corresponding to pressure pocket 52, the pressure pocket 50 in toothed wheel 10 has tooth pocket sections 56 introduced into the tooth end faces 53, pressure pocket 50 thus being introduced into the axial surface 34 over a large area and being larger in extent than pressure pocket 52. Pressure pocket 50 is then delimited radially by a wall 58 running around the periphery of toothed wheel 14.

In the case of the driving toothed wheel 10, the axial force component 47 acting is greater than in the case of the driven toothed wheel 12, see FIG. 2. By means of the pressure pocket 50 with a larger area than pressure pocket 52, a larger pressure application area for the high pressure of the toothed wheel machine 1 is created on toothed wheel 10 and, as a result, a higher counter-force acts on toothed wheel 10 than on toothed wheel 12, in accordance with the larger axial force component 47.

As already explained, the counter-forces applied to toothed wheels 10, 12 via pressure pockets 50 and 52 are less than or equal to the respective axial force components 47, 49 in FIG. 2. This reduces the sliding friction between the toothed wheels 10, 12 and bearing body 28, thereby minimizing wear. The counter-force thus acts as a means of compensating axial force on the toothed wheels 10, 12. The resultant forces arising from the axial force components 47, 49 and the counter-forces then serve for axial-gap compensation of the sliding gap between toothed wheels 10, 12 and bearing body 28 (provided the resultant force is not zero). No measures for compensating an axial gap between the toothed wheels 10, 12 and the bearing bodies 26, 28 are necessary at that end face of bearing body 28 which faces housing cover 4 and, as a result, production is very simple here and does not require any major outlay on machining.

The bearing body 26 on the right in FIG. 1 is not acted upon by any resultant force from the axial force components and the counter-forces. The sliding gap between the toothed wheels 10, 12 and bearing body 26 is compensated for in a conventional manner, independently of the axial force components and counter-forces between the toothed wheels 10, 12 and bearing body 28.

Figure 4:
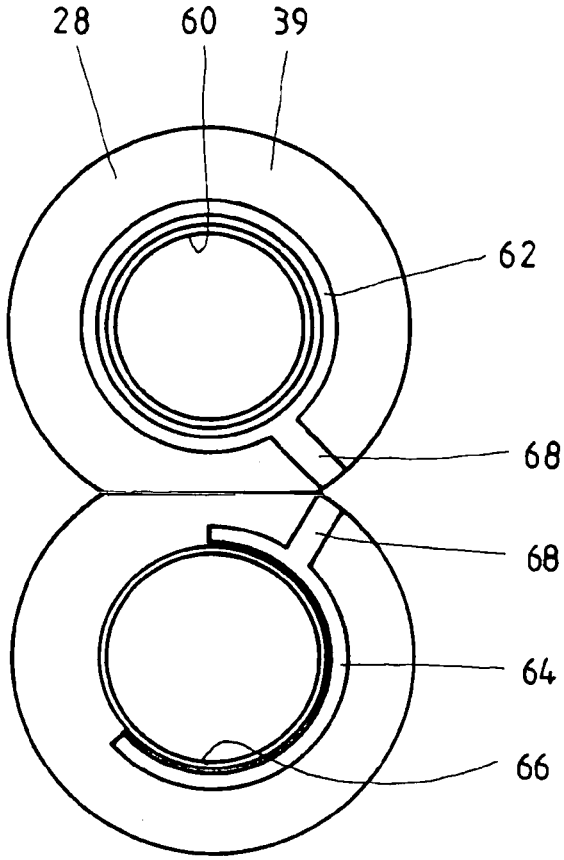
FIG. 4 shows a plan view of a bearing body of a third illustrative embodiment of the toothed wheels.

FIG. 4 shows the end face 39 of a spectacle-shaped bearing body 28, situated on the left in FIG. 1, of a third illustrative embodiment, said end face facing the toothed wheels 10, 12 from FIG. 1. Bearing body 28 can be of two-part design, as illustrated in FIG. 4. A first, annular pressure groove 62 is introduced into the end face 39 of bearing body 28, running around a bearing eye 60 at the top in FIG. 4. A second pressure groove 64 is formed substantially in the high pressure zone of the toothed wheel machine 1, spanning a partial circle around the lower bearing eye 66 of bearing body 28. The pressure grooves 62, 64 are in pressure-medium communication with the high pressure of the toothed wheel machine 1 via radial grooves 68. Pressure groove 62 forms a first pressure field, and pressure groove 64 forms a second pressure field, which is smaller than the first pressure field. Here too, therefore, the axial forces 47, 49 of different magnitudes are counteracted by counter-forces of different magnitude.

In the case of the illustrative embodiments shown in FIGS. 3 and 4, axial-force compensation between the toothed wheels 10, 12 and bearing body 28 is thus implemented with very little outlay in terms of apparatus. For example, there is no need for additional components, and this leads to low production costs. The internal hydraulic forces of the toothed wheel machine 1 can be used directly for axial-force compensation, thereby enabling said forces to be linked directly to the operating conditions of the toothed wheel machine 1. Here, bearing body 28 rests against cover 4 under the action of the entire axial force.

The operation of the axial-gap and axial-force compensation explained above is independent of the construction of the bearing elements used and can therefore be employed for all components suitable for axial sealing of toothed wheel machines. The same applies also to the type of toothing and the parameters thereof. Such axial-gap and axial-force compensation can be employed both in external and internal toothed wheel machines.

The toothed wheel machine can be used as a gear pump or motor.

The disclosure is of a toothed wheel machine having a housing for accommodating two intermeshing toothed wheels. These are supported in a sliding manner axially by axial surfaces between bearing bodies accommodated in the housing and radially by respective bearing shafts accommodated in the bearing bodies. During the operation of the toothed wheel machine, an axial force component of a force resulting from hydraulic and mechanical forces arising during operation acts on each toothed wheel in the same axial direction. A counter-force against the respective axial force component is then applied to the toothed wheels and/or bearing shafts, the magnitude of said counter-force being equal to or less than that of the respective axial force component.

The invention claimed is:

1. A toothed wheel machine comprising:

a housing;

a first bearing body accommodated in the housing and including a first axial surface;

a second bearing body accommodated in the housing and including a second axial surface;

a first bearing shaft accommodated in the bearing bodies;

a second bearing shaft accommodated in the bearing bodies;

a first toothed wheel accommodated in the housing, supported axially between the bearing bodies in a slidable manner by the first and second axial surfaces, and supported radially by the first bearing shaft, a second toothed wheel intermeshing with the first toothed wheel and being accommodated in the housing, the second toothed wheel being supported axially between the bearing bodies in a slidable manner by the first and second axial surfaces, and supported radially by the second bearing shaft, wherein a first axial force component of a force resulting from hydraulic and mechanical forces arising during operation of the toothed wheel machine acts on the first toothed wheel in a first axial direction against the first bearing body, and wherein the first toothed wheel and the first bearing body are configured such that a first counter-force acts on one of the first toothed wheel and the first bearing shaft in a direction opposite to the first axial force component and with a first magnitude that is less than that of the first axial force component such that the first toothed wheel is forced in the first axial direction against the first bearing body with a first resultant force that is smaller in magnitude than the first axial force component.

2. The toothed wheel machine as claimed in claim 1, wherein the toothed wheels are helically toothed.

3. The toothed wheel machine as claimed in claim 1, wherein:

the first bearing body is positioned relative to the toothed wheels in the first axial direction, and the first bearing body is pressed against a housing cover of the housing mechanically by way of the toothed wheels and/or hydraulically by way of a pressure force.

4. The toothed wheel machine as claimed in claim 3, wherein a hydraulic pressure is applied to the second bearing body at an end face on a housing side of the second bearing body facing away from the toothed wheels.

5. The toothed wheel machine as claimed in claim 1, wherein the first counter-force includes at least one of a pressure force and a mechanical force.

6. The toothed wheel machine as claimed in claim 1, wherein the first bearing body and the second bearing body are each of two-part design.

7. The toothed wheel machine as claimed in claim 1, wherein a second axial force component of the force resulting from hydraulic and mechanical forces arising during operation of the toothed wheel machine acts on the second toothed wheel in the first axial direction.

8. The toothed wheel machine as claimed in claim 7, wherein:

the second toothed wheel and the first bearing body are configured such that a second counter-force acts on one of the second toothed wheel and the first bearing shaft in a direction opposite to the second axial force component with a second magnitude that is less than that of the second axial force component such that the second toothed wheel is forced in the first axial direction against the first bearing body with a second resultant force that is smaller in magnitude than the second axial force component, and the first and second counter-forces acting against the first and second axial force components, respectively, are applied to the first and second toothed wheels, respectively, or the first and second bearing shafts, respectively.

9. The toothed wheel machine as claimed in claim 8, wherein the second counter-force includes at least one of a pressure force and a mechanical force.

10. The toothed wheel machine as claimed in claim 8, wherein a pressure cavity defined between one of the first and second toothed wheels and the first bearing body produces a pressure field which generates at least one of (i) the first counter-force acting on the first toothed wheel and (ii) the second counter-force acting on the second toothed wheel.

11. The toothed wheel machine as claimed in claim 10, wherein at least one of the first toothed wheel and the second toothed wheel includes a pressure pocket, which is defined in an axial surface of the at least one of the first toothed wheel and the second toothed wheel which faces the first bearing body in order to delimit the pressure field.

12. The toothed wheel machine as claimed in claim 11, wherein:

the axial surface of the at least one of the first and second toothed wheels includes tooth end faces and of an annular surface, and the pressure pocket comprises at least one annular groove introduced into the annular surface extending approximately concentrically around a longitudinal axis of the at least one of the first and second toothed wheels.

13. The toothed wheel machine as claimed in claim 12, wherein the pressure pocket is enlarged by tooth pocket sections defined in the tooth end faces of the at least one of the first and second toothed wheels.

14. The toothed wheel machine as claimed in claim 13, wherein:

the first toothed wheel drives the second toothed wheel, the annular groove is defined in an axial surface of the second toothed wheel which faces the first bearing body, and the pressure pocket together with the tooth pocket sections are defined in an axial surface of the first toothed wheel which faces the first bearing body.

15. The toothed wheel machine as claimed in claim 11, wherein the pressure pockets are in pressure-medium communication with a high pressure zone of the toothed wheel machine.

16. A toothed wheel machine comprising:

a housing;

a first bearing body accommodated in the housing and including a first axial surface;

a second bearing body accommodated in the housing and including a second axial surface:

a first bearing shaft accommodated in the bearing bodies;

a second bearing shaft accommodated in the bearing bodies;

a first toothed wheel accommodated in the housing, supported axially between the bearing bodies in a slidable manner by the first and second axial surfaces, and supported radially by the first bearing shaft, a second toothed wheel intermeshing with the first toothed wheel and being accommodated in the housing, the second toothed wheel being supported axially between the bearing bodies in a slidable manner by the first and second axial surfaces, and supported radially by the second bearing shaft, wherein a first axial force component of a force resulting from hydraulic and mechanical forces arising during operation of the toothed wheel machine acts on the first toothed wheel in a first axial direction, wherein a first counter-force acting against the first axial force component is applied to one of the first toothed wheel and the first bearing shaft, wherein a first magnitude of the first counter-force is less than that of the first axial force component, wherein an axial surface of the first bearing body facing the toothed wheels includes a first groove extending at least partially around an inner circumference of the first bearing body adjacent a first bearing eye and a second groove extending away from the first groove to fluidly connect the first groove with a high pressure zone of the toothed wheel machine, the first groove defining a pressure cavity between the first toothed wheel and the first bearing body to produce a pressure field which generates the first counter-force acting on the first toothed wheel, and wherein the first groove defines a first circumferential length and the second groove defines a second circumferential length that is less than the first circumferential length.

17. The toothed wheel machine as claimed in claim 16, wherein:

the first groove extends concentrically entirely around the first bearing eye, the axial surface of the first bearing body facing the toothed wheels defines a second annular groove spanning a partial circle around a second bearing eye, and the second annular groove is in pressure-medium communication with the high pressure zone of the toothed wheel machine via a pressure-medium port.

18. A toothed wheel machine comprising:

a housing;

a first bearing body accommodated in the housing and including a first axial surface;

a second bearing body accommodated in the housing and including a second axial surface:

a first bearing shaft accommodated in the bearing bodies;

a second bearing shaft accommodated in the bearing bodies;

a first toothed wheel accommodated in the housing, supported axially between the bearing bodies in a slidable manner by the first and second axial surfaces, and supported radially by the first bearing shaft, a second toothed wheel intermeshing with the first toothed wheel and being accommodated in the housing, the second toothed wheel being supported axially between the bearing bodies in a slidable manner by the first and second axial surfaces, and supported radially by the second bearing shaft, wherein:

a first axial force component of a force resulting from hydraulic and mechanical forces arising during operation of the toothed wheel machine acts on the first toothed wheel in a first axial direction, a first counter-force acting against the first axial force component is applied to one of the first toothed wheel and the first bearing shaft, a first magnitude of the first counter-force is less than that of the first axial force component, wherein a second axial force component of the force resulting from hydraulic and mechanical forces arising during operation of the toothed wheel machine acts on the second toothed wheel in the first axial direction, a second counter-force acting against the second axial force component is applied to one of the second toothed wheel and the second bearing shaft, and a second magnitude of the second counter-force is less than that of the second axial force component, the first and second counter-forces acting against the first and second axial force components, respectively, are applied to the first and second toothed wheels, respectively, or the first and second bearing shafts, respectively, the first bearing body is positioned relative to the toothed wheels in the first axial direction, the first bearing body is pressed against a housing cover of the housing mechanically by way of the toothed wheels and/or hydraulically by way of a pressure force, a first piston is supported in a sliding manner in the housing cover of the housing, approximately coaxially with respect to the first toothed wheel longitudinal axis, the first piston being configured to apply force to the first bearing shaft, a second piston is supported in a sliding manner in the housing cover of the housing, approximately coaxially with respect to the second toothed wheel longitudinal axis, the second piston being configured to apply force to the second bearing shaft, the first piston rests by way of a first piston end face against a shaft end face of the first bearing shaft which faces in the first axial direction and the second piston rests by way of a second piston end face against a shaft end face of the second bearing shaft which faces in the first axial direction, and pressure is applied to a third piston end face of the first piston and a fourth piston end face of the second piston.

19. The toothed wheel machine as claimed in claim 18, wherein the two pistons have pressure application areas of different sizes in comparison with one another.

20. The toothed wheel machine as claimed in claim 19, wherein the third and fourth piston end faces of the pistons are connected to a high pressure zone of the toothed wheel machine.

* * * * *